US009818595B2

(12) United States Patent
Remes et al.

(10) Patent No.: US 9,818,595 B2
(45) Date of Patent: Nov. 14, 2017

(54) SYSTEMS AND METHODS FOR ION ISOLATION USING A DUAL WAVEFORM

(71) Applicant: Thermo Finnigan LLC, San Jose, CA (US)

(72) Inventors: Philip M. Remes, San Jose, CA (US); Michael W. Senko, Sunnyvale, CA (US); Jae C. Schwartz, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 14/709,329

(22) Filed: May 11, 2015

(65) Prior Publication Data

US 2016/0336163 A1 Nov. 17, 2016

(51) Int. Cl.
*H01J 49/42* (2006.01)

(52) U.S. Cl.
CPC ..... *H01J 49/422* (2013.01); *H01J 49/428* (2013.01)

(58) Field of Classification Search
CPC ..... H01J 49/0063; H01J 49/0031; H01J 49/4285; H01J 49/428
See application file for complete search history.

(56) References Cited

U.S. PATENT DOCUMENTS 4,761,545 A 8/1988 Marshall et al.
5,134,286 A 7/1992 Kelley
5,324,939 A 6/1994 Louris et al.
6,633,033 B2 10/2003 Yoshinari et al.
7,378,648 B2 5/2008 Wang et al.
7,928,373 B2 4/2011 Quarmby et al.
2003/0122071 A1* 7/2003 Plomley ..... H01J 49/004 250/292
2003/0150988 A1* 8/2003 Wells ..... H01J 49/428 250/292

(Continued)

FOREIGN PATENT DOCUMENTS

EP 0362432 A1 4/1990
EP 0700069 A2 3/1996

(Continued)

OTHER PUBLICATIONS

Soni, et al., "Selective Injection and Isolation of Ions in Quadrupole Ion Trap Mass Spectrometry Using Notched Waveforms Created Using the Inverse Fourier Transform," Analytical Chemistry, vol. 66, No. 15, 1994, pp. 2488-2496.

(Continued)

*Primary Examiner* — Wyatt Stoffa
(74) *Attorney, Agent, or Firm* — David A. Schell

(57) ABSTRACT

A mass spectrometer includes a radio frequency ion trap; and a controller. The controller is configured to cause an ion population to be injected into the radio frequency ion trap; supply a first isolation waveform to the radio frequency ion trap for a first duration, and supply a second isolation waveform to the radio frequency ion trap for a second duration. The first isolation waveform has at least a first wide notch at a first mass-to-charge ratio, and the second isolation waveform has at least a first narrow notch at the first mass-to-charge ratio. The first and second isolation waveforms are effective to isolate one or more precursor ions from the ion population.

27 Claims, 6 Drawing Sheets

(56) References Cited

U.S. PATENT DOCUMENTS

| | | | | |
|---|---|---|---|---|
| 2004/0122071 | A1* | 6/2004 | Kim | A61K 9/0014 514/383 |
| 2007/0164208 | A1* | 7/2007 | Quarmby | H01J 49/427 250/282 |
| 2009/0032698 | A1 | 2/2009 | Furuhashi et al. | |
| 2010/0084547 | A1* | 4/2010 | Pringle | H01J 49/428 250/282 |
| 2010/0237236 | A1 | 9/2010 | Thomson et al. | |
| 2012/0049059 | A1 | 3/2012 | Taniguchi | |
| 2014/0339421 | A1 | 11/2014 | Senko | |
| 2016/0020083 | A1* | 1/2016 | McAlister | H01J 49/428 250/283 |

FOREIGN PATENT DOCUMENTS

| | | | |
|---|---|---|---|
| WO | 2008/090365 | A2 | 7/2008 |
| WO | WO 2013/112677 | A2 | 8/2013 |
| WO | 2014/159478 | A1 | 10/2014 |
| WO | 2014/200987 | A2 | 12/2014 |

OTHER PUBLICATIONS

March, "An Introduction to Quadrupole Ion Trap Mass Spectrometry", Journal of Mass Spectrometry, 1997, vol. 32 (4), pp. 351-369.

Wells et al., "High-Resolution Selected Ion Monitoring in a Quadrupole Ion Trap Mass Spectrometer", Anal. Chem. 1995, 67, pp. 3650-3655.

* cited by examiner

SYSTEMS AND METHODS FOR ION ISOLATION USING A DUAL WAVEFORM

FIELD

The present disclosure generally relates to the field of mass spectrometry including systems and methods for ion isolation.

INTRODUCTION

Tandem mass spectrometry, referred to as MS/MS, is a popular and widely-used analytical technique whereby precursor ions derived from a sample are subjected to fragmentation under controlled conditions to produce product ions. The product ion spectra contain information that is useful for structural elucidation and for identification of sample components with high specificity. In a typical MS/MS experiment, a relatively small number of precursor ion species are selected for fragmentation, for example those ion species of greatest abundances or those having mass-to-charge ratios (m/z's) matching values in an inclusion list.

The process of ion isolation can be complicated by ion-ion interaction effects, like all other ion trapping procedures. It is well known that ion-ion interactions can shift the oscillation frequency of ions in the trap to lower frequencies. Additionally, ion-ion interactions can increase the size of the cloud of trapped ions, such that higher order fields can cause ion frequencies to shift to higher frequencies. The precursor oscillation frequency can shift into the range of waveform frequencies that have non-zero energy, resulting in loss of the precursor isolation efficiency. Thus the isolation of precursor ions in the presence of large ion populations is difficult. From the foregoing it will be appreciated that a need exists for improved methods for ion isolation in mass spectrometry.

SUMMARY

In a first aspect, a mass spectrometer can include a radio frequency ion trap and a controller. The controller can be configured to cause an ion population to be injected into the radio frequency ion trap, supply a first isolation waveform to the radio frequency ion trap for a first duration, and supply a second isolation waveform to the radio frequency ion trap for a second duration. The first isolation waveform can have at least a first wide notch at a first mass-to-charge ratio, and the second isolation waveform can have at least a first narrow notch at the first mass-to-charge ratio. The first wide notch and the first narrow notch can have q values that differ by not greater than a factor of about 2. The first and second isolation waveforms can be effective to isolate one or more precursor ions of different mass-to-charge ratios from the ion population.

In various embodiments of the first aspect, the first wide notch can encompass the first narrow notch.

In various embodiments of the first aspect, the controller can be configured to supply the first isolation waveform concurrent with the injection of the ion population and supply the second isolation waveform subsequent to the injection of the ion population.

In various embodiments of the first aspect, the controller can be configured to supply the first isolation waveform subsequent to the injection of the ion population and supply the second isolation waveform subsequent to the first isolation waveform.

In various embodiments of the first aspect, the first wide notch and the first narrow notch can have q values that differ by not greater than a factor of about 1.5. In particular embodiments, the q values of the first wide notch and the first narrow notch can differ by not greater than a factor of about 1.25.

In various embodiments of the first aspect, a width of the first wide notch can be not less than about 8 Da.

In various embodiments of the first aspect, a width of the first narrow notch can be not greater than about 5 Da.

In various embodiments of the first aspect, a width of the first wide notch can be not less than about 2 times a width of the first narrow notch. In particular embodiments, the width of the first wide notch can be not less than about 2.5 times the width of the first narrow notch.

In various embodiments of the first aspect, the first waveform can include a second wide notch at a second mass-to-charge ratio and the second waveform can include a second narrow notch at the second mass-to-charge ratio. In various embodiments, a q value of the second wide notch and a q value of the second narrow notch can differ by not greater than a factor of about 2.

In various embodiments of the first aspect, the controller can be further configured to supply additional isolation waveforms having successively narrower notches at the first mass-to-charge ratio.

In a second aspect, a mass spectrometer can include a radio frequency ion trap, and a controller. The controller can be configured to cause an ion population to be injected into the radio frequency ion trap, supply a first isolation waveform to the radio frequency ion trap for a first duration, and supply a second isolation waveform to the radio frequency ion trap for a second duration. The first isolation waveform can have at least a first wide notch encompassing a first mass-to-charge ratio, and the second isolation waveform can have at least a first narrow notch encompassing the first mass-to-charge ratio. The first wide notch and the first narrow notch can have q values greater than about 0.45, and the first and second isolation waveforms can be effective to isolate one or more precursor ions from the ion population.

In various embodiments of the second aspect, the first wide notch can encompass the first narrow notch.

In various embodiments of the second aspect, the controller can be configured to supply the first isolation waveform concurrent with the injection of the ion population and supply the second isolation waveform subsequent to the injection of the ion population.

In various embodiments of the second aspect, the controller can be configured to supply the first isolation waveform subsequent to the injection of the ion population and supply the second isolation waveform subsequent to the first isolation waveform.

In various embodiments of the second aspect, the first wide notch and the first narrow notch can have q values that differ by not greater than a factor of about 2.0. In particular embodiments, the q values of the first wide notch and the first narrow notch can differ by not greater than a factor of about 1.5. In particular embodiments, the q values of the first wide notch and the first narrow notch can differ by not greater than a factor of about 1.25.

In various embodiments of the second aspect, a width of the first wide notch can be not less than about 8 Da.

In various embodiments of the second aspect, a width of the first narrow notch can be not greater than about 5 Da.

In various embodiments of the second aspect, a width of the first wide notch can be not less than about 2 times a width of the first narrow notch. In particular embodiments, the width of the first wide notch can be not less than about 2.5 times the width of the first narrow notch.

In various embodiments of the second aspect, the first waveform can include a second wide notch at a second mass-to-charge ratio and the second waveform can include a second narrow notch at the second mass-to-charge ratio. In particular embodiments, the second mass-to-charge ratio can be less than the first mass-to-charge ratio. In particular embodiments, a q value of the second wide notch and a q value of the second narrow notch can be greater than about 0.45.

In various embodiments of the second aspect, the controller can be further configured to supply additional isolation waveforms having successively narrower notches at the first mass-to-charge ratio.

In a third aspect, a mass spectrometer can include a radio frequency ion trap, and a controller. The controller can be configured to cause an ion population to be injected into the radio frequency ion trap, supply a first isolation waveform to the radio frequency ion trap for a first duration, and supply a second isolation waveform to the radio frequency ion trap for a second duration. The first isolation waveform can have a plurality of wide notches centered at a plurality of target mass-to-charge ratios, and the second isolation waveform can have a plurality of narrow notches centered at the plurality of target mass-to-charge ratios. At a given target mass-to-charge ratio, the corresponding wide and narrow notches can have q values that differ by not greater than a factor of about 2. The first and second isolation waveforms can be effective to isolate a plurality of precursor ions from the ion population.

In various embodiments of the third aspect, the controller can be configured to supply the first isolation waveform concurrent with the injection of the ion population and supply the second isolation waveform subsequent to the injection of the ion population.

In various embodiments of the third aspect, the controller can be configured to supply the first isolation waveform subsequent to the injection of the ion population and supply the second isolation waveform subsequent to the first isolation waveform.

In various embodiments of the third aspect, at a given target mass-to-charge ratio, the corresponding wide and narrow notches can have q values that differ by not greater than a factor of about 1.5. In particular embodiments, at a given target mass-to-charge ratio, the corresponding wide and narrow notches can have q values that differ by not greater than a factor of about 1.25.

In various embodiments of the third aspect, the wide notches can have a width of not less than about 8 Da.

In various embodiments of the third aspect, the narrow notches can have a width of not greater than about 5 Da.

In various embodiments of the third aspect, at a given target mass-to-charge ratio, the corresponding wide notch can have a width of not less than about 2 times a width of the corresponding narrow notch. In particular embodiments, at a given target mass-to-charge ratio, the width of the corresponding wide notch can be not less than about 2.5 times the width of the corresponding narrow notch.

In various embodiments of the third aspect, the controller can be further configured to supply additional isolation waveforms having successively narrower notches centered at the plurality of target mass-to-charge ratios.

In a fourth aspect, a mass spectrometer can include a radio frequency ion trap, and a controller. The controller can be configured to cause an ion population to be injected into the radio frequency ion trap; supply a first isolation waveform to the radio frequency ion trap for a first duration, and supply a second isolation waveform to the radio frequency ion trap for a second duration. The first isolation waveform can have a plurality of wide notches centered at a plurality of target mass-to-charge ratios, and the second isolation waveform can have a plurality of narrow notches centered at the plurality of target mass-to-charge ratios. At a highest target mass-to-charge ratio, the corresponding wide and narrow notches can have q values greater than about 0.45. The first and second isolation waveforms can be effective to isolate a plurality of precursor ions from the ion population.

In various embodiments of the fourth aspect, the controller can be configured to supply the first isolation waveform concurrent with the injection of the ion population and supply the second isolation waveform subsequent to the injection of the ion population.

In various embodiments of the fourth aspect, wherein the controller can be configured to supply the first isolation waveform subsequent to the injection of the ion population and supply the second isolation waveform subsequent to the first isolation waveform.

In various embodiments of the fourth aspect, at a given target mass-to-charge ratio, the corresponding wide notches and the corresponding narrow notches can have q values that differ by not greater than a factor of about 2.0. In particular embodiments, at a given target mass-to-charge ratio, the q values of the corresponding wide notch and the corresponding narrow notch can differ by not greater than a factor of about 1.5. In particular embodiments, at a given target mass-to-charge ratio, the q values of the corresponding wide notch and the corresponding narrow notch can differ by not greater than a factor of about 1.25.

In various embodiments of the fourth aspect, the wide notches can have a width of not less than about 8 Da.

In various embodiments of the fourth aspect, the narrow notches can have a width of not greater than about 5 Da.

In various embodiments of the fourth aspect, at a given target mass-to-charge ratio, a width of the corresponding wide notch can be not less than about 2 times a width of the corresponding narrow notch.

In various embodiments of the fourth aspect, at a given target mass-to-charge ratio, the width of the corresponding wide notches can be not less than about 2.5 times the width of the corresponding narrow notches.

In various embodiments of the fourth aspect, the controller can be further configured to supply additional isolation waveforms having successively narrower notches at the plurality of target mass-to-charge ratios.

DRAWINGS

For a more complete understanding of the principles disclosed herein, and the advantages thereof, reference is now made to the following descriptions taken in conjunction with the accompanying drawings, in which.

Figure 1:
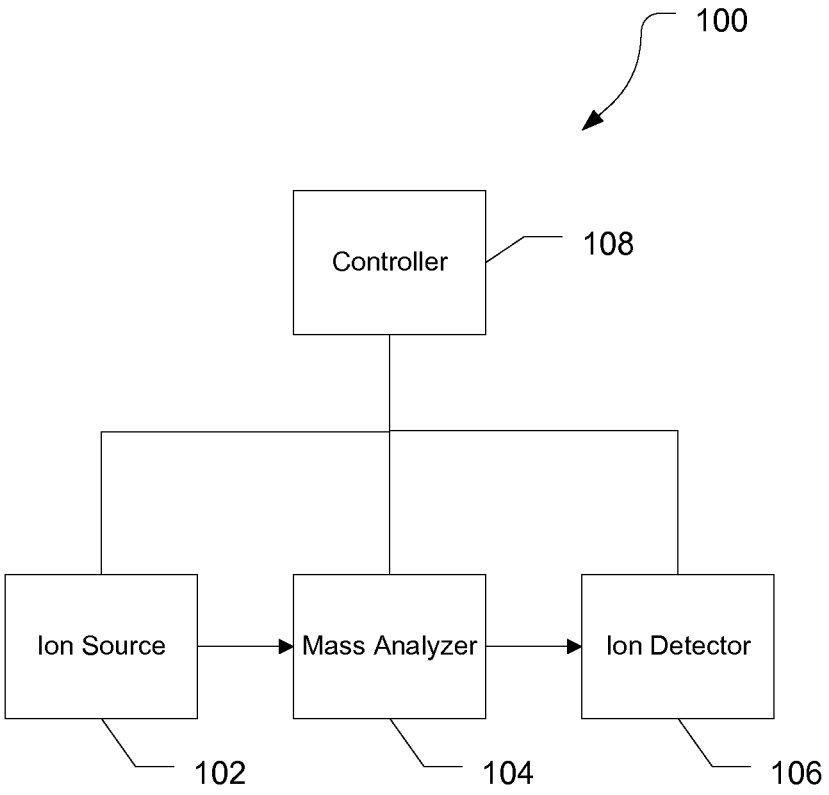
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion isolation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like.

In various embodiments, the mass analyzer 104 can separate ions based on a mass to charge ratio of the ions. For example, the mass analyzer 104 can include a quadrupole mass filter analyzer, a quadrupole ion trap analyzer, a time-of-flight (TOF) analyzer, an electrostatic trap (e.g., Orbitrap) mass analyzer, Fourier transform ion cyclotron resonance (FT-ICR) mass analyzer, and the like. In various embodiments, the mass analyzer 104 can also be configured to fragment the ions using collision induced dissociation (CID) electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detected negative ions.

Ion Isolation Method

Figure 2:
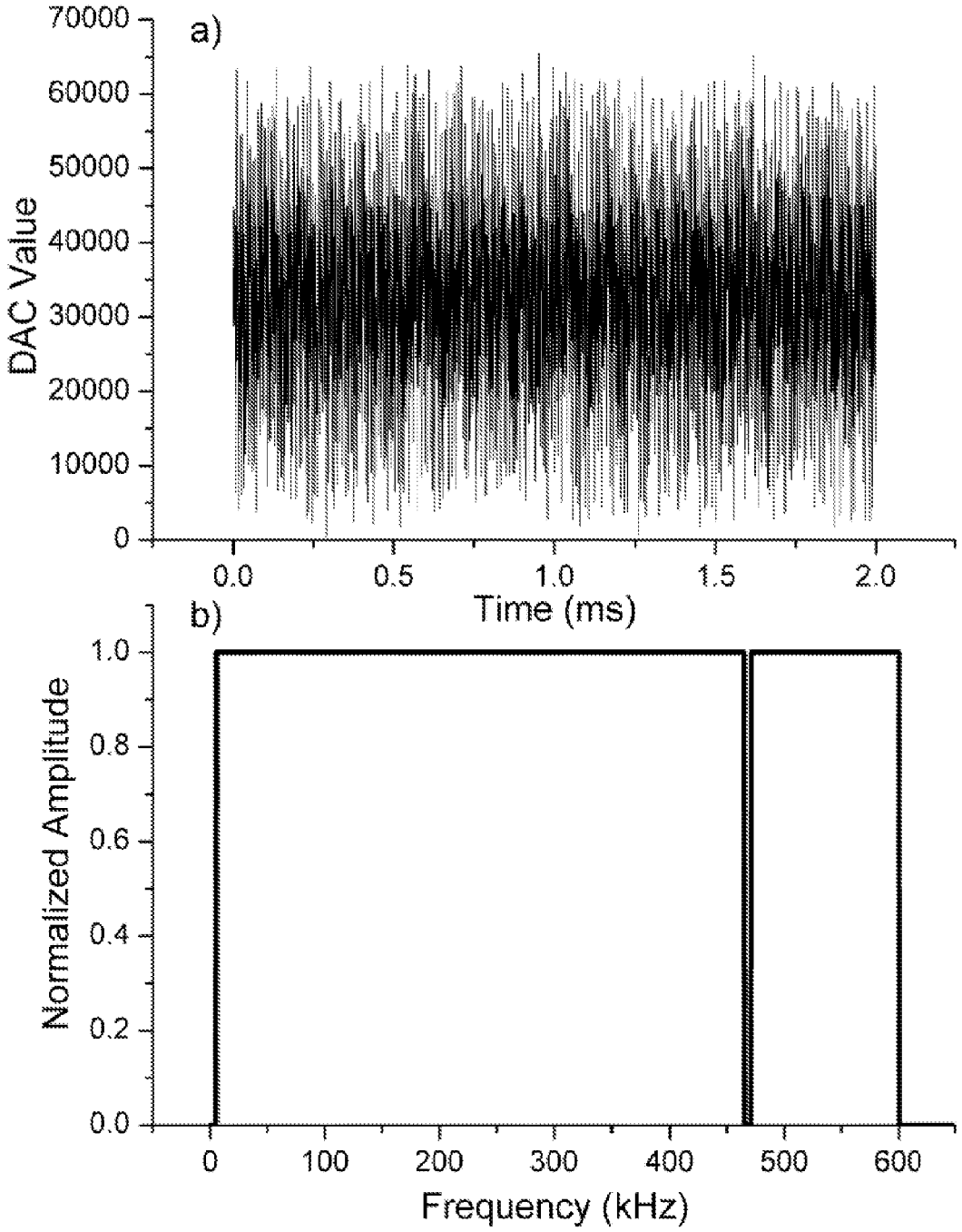
FIG. 2 is an illustration of an exemplary isolation waveform, in accordance with various embodiments.

Ion isolation is the process of removing unwanted or interfering ions from a sample being analyzed, while retaining ions that are desired for further processing and or analysis. In ion traps utilizing nominally quadrupole potentials, the isolation of ions can be achieved by the application of broadband supplementary ac waveforms containing energy at the oscillation frequencies of the unwanted or interfering ions and no energy at the oscillation frequencies of the precursor ions, forming a "notch". FIG. 2 shows an exemplary isolation waveform both in the time domain (a) and in the frequency domain (b) with a notch around 475 kHz.

Figure 3:
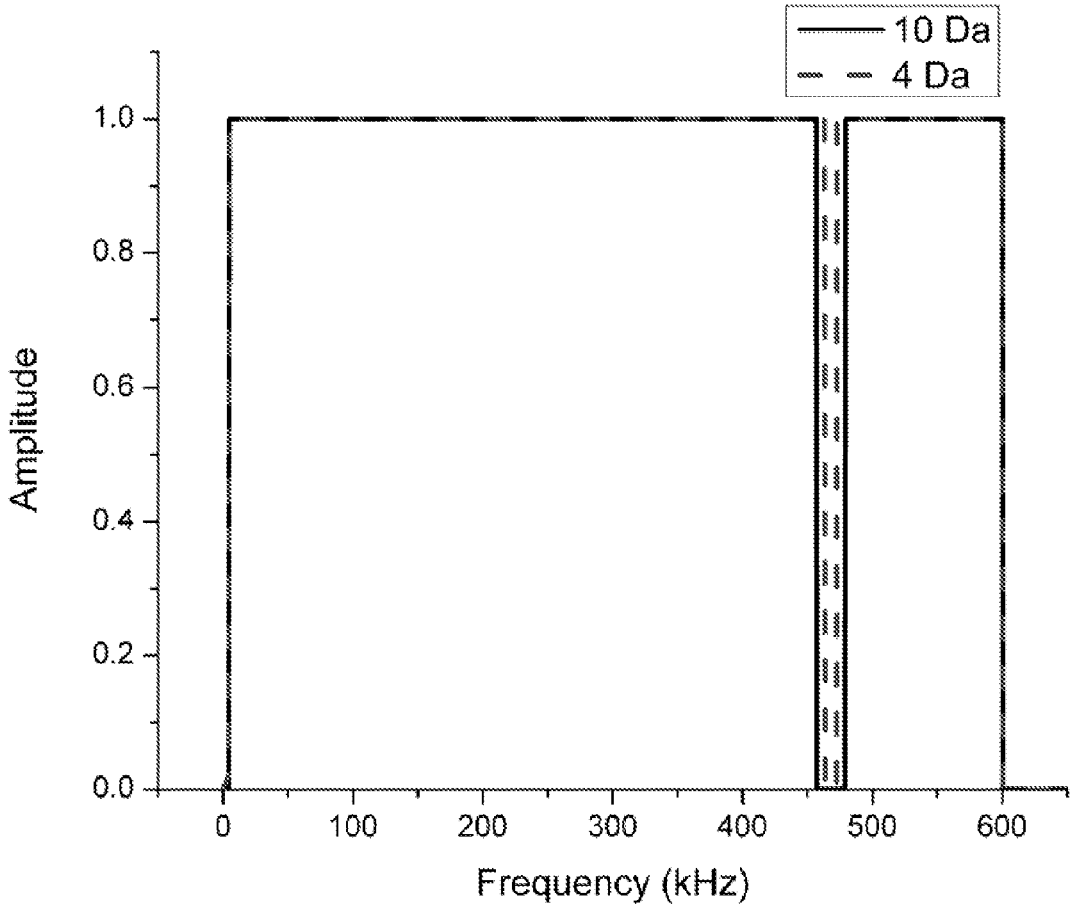
FIG. 3 is an illustration of an exemplary dual isolation waveform, in accordance with various embodiments.

FIG. 3 shows frequency domain signals of two exemplary isolation waveforms having notches around 475 kHz. The first waveform with a wider notch having a width of 10 Da can be used for the first isolation step, while the narrower 4 Da notch in the second waveform can be used for the second, narrower isolation step. In various embodiments, additional waveforms with subsequently narrow notches can be used to further refine the isolation of precursor ions.

Figure 4:
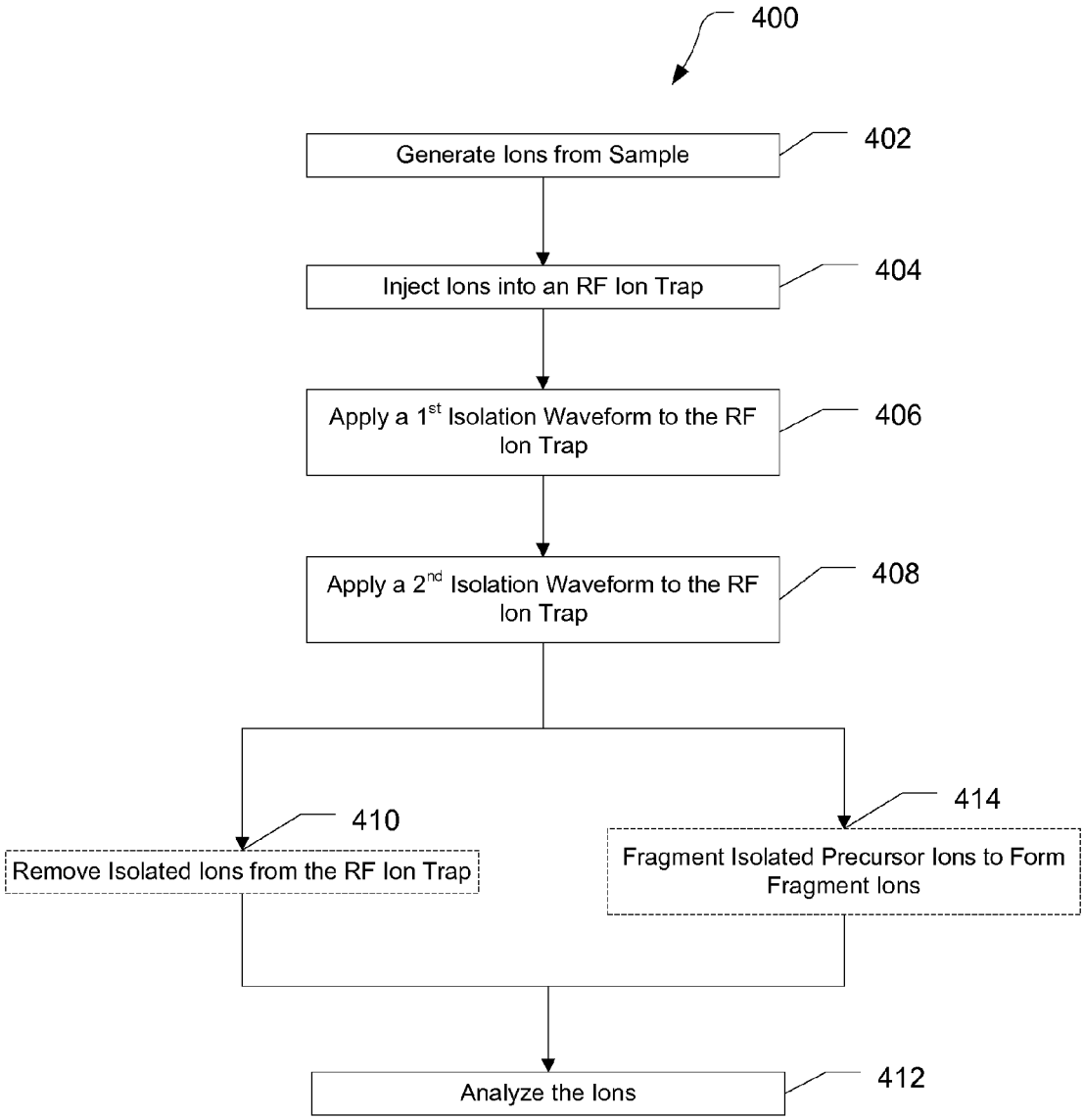
FIG. 4 is a flow diagram illustrating an exemplary method for isolating ions, in accordance with various embodiments.

FIG. 4 is a flow diagram of an exemplary method 400 of isolating ions in a radio frequency (RF) Ion Trap and subsequently analyzing the isolated ions. At 402, ions are generated from a sample. In various embodiments, the sample can be provided by a gas chromatograph, a liquid chromatograph, direct application, or other means of supplying a sample to a mass spectrometer. The sample may be ionized by various methods including but not limited to MALDI, ESI, APCI, APPI, ICP, electron ionization, chemical ionization, photoionization, glow discharge ionization, thermospray ionization, and the like.

At 404, the ions can be injected into a RF ion trap. In various embodiments, the ions can be transported from an ion source to the RF ion trap by way of various ion guides, ion lenses, and the like. The RF ion trap can trap the ions within a quadrupolar potential.

At 406, a first isolation waveform can be applied to the RF ion trap. In various embodiments, the first isolation waveform can be applied during injection or subsequent to injection. In various embodiments, the first isolation waveform can have at least one notch at a target mass-to-charge (m/z) ratio. In various embodiments, the first isolation waveform can include a plurality of notches at a plurality of target m/z ratios, such as, for example, a first notch at a first m/z ratio and a second notch at a second m/z ratio. The second m/z ratio can be less than or greater than the first m/z ratio.

At 408, a second isolation waveform can be applied to the RF ion trap. In various embodiments, the second isolation waveform can be applied after the first isolation waveform has been applied, and can be applied subsequent to the injection of the ions. In various embodiments, the second isolation waveform can have at least one notch at a target mass-to-charge (m/z) ratio, such as, for example, a first notch at a first m/z ratio and a second notch at a second m/z ratio. The second m/z ratio can be less than or greater than the first m/z ratio.

In various embodiments, the second isolation waveform can include a plurality of notches at a plurality of target m/z ratios. In various embodiments, notches in the second isolation waveform can correspond to notches in the first isolation waveform, such that corresponding notches in the first and second isolation waveform are at the same target m/z ratio.

In various embodiments, a notch in the first isolation waveform can encompass a corresponding notch in the second isolation waveform, such that the entire width of the notch in the second isolation waveform can be spanned by the notch in the first isolation waveform.

In various embodiments, corresponding notches in the first and second isolation waveforms, such as the notches at the highest m/z ratio, can have q values that differ by not greater than a factor of about 2.0, such as not greater than a factor of about 1.5, even not greater than a factor of about 1.25. In various embodiments where the first and second isolation waveforms include a plurality of notches, the second notch of the first and second isolation waveform can have q values that differ by not greater than a factor of about 2.0. In various embodiments, the q values of the corresponding notches, such as the notches at the highest m/z ratio, can be greater than about 0.45. In various embodiments, a second set of corresponding notches in the first and second isolation waveforms can have q values that are greater than about 0.45.

In various embodiments, a notch in the first isolation waveform can have a width of not less than about 8 Da. In various embodiments, a notch in the second isolation waveform can have a width of not greater than about 5 Da. In various embodiments, the width of a notch in the first isolation waveform can be not less than about 2 times, such as not less than 2.5 times, the width of the corresponding notch in the second isolation waveform.

In various embodiments, additional waveforms can be applied to the RF ion trap, with corresponding notches in each successive waveform. Each successive waveform may have successively narrower notches.

In various embodiments, the notches in the first and second isolation waveforms can be effective to isolate a plurality of precursor ions from an ion population. In the case of isolation waveforms with multiple notches, the precursor ions can have multiple discrete m/z ratios.

In various embodiments, as indicated at 410, the isolated precursor ions can be removed from the RF ion trap for further analysis. In various embodiments, the isolated precursor ions can be removed to a storage device or a mass analyzer. In various embodiments, the precursor ions can be scanned out of the RF ion trap to separate the ions by m/z ratio and sent to a detector. In other embodiments, the precursor ions can be removed from the RF ion trap substantially simultaneously to form an ion packet including substantially all the precursor ions that is sent to a storage device, mass analyzer, or the like.

At 412, the precursor ions can be analyzed, such as by determining their m/z ratios, such as by detecting the ions as the ions are scanned out of the RF ion trap or by use of another analyzer, such as a time-of-flight analyzer, an electrostatic trap analyzer, or the like.

In other embodiments, as illustrated at 414, the isolated precursor ions can be fragmented to form ion fragments. In various embodiments, the precursor ions can be fragmented within the RF ion trap. In other embodiments, the precursor ions can be removed from the RF ion trap and fragmented, such as in a collision cell. Once fragmented, the ion fragments can be analyzed, as indicated at 412.

Computer-Implemented System

Figure 5:
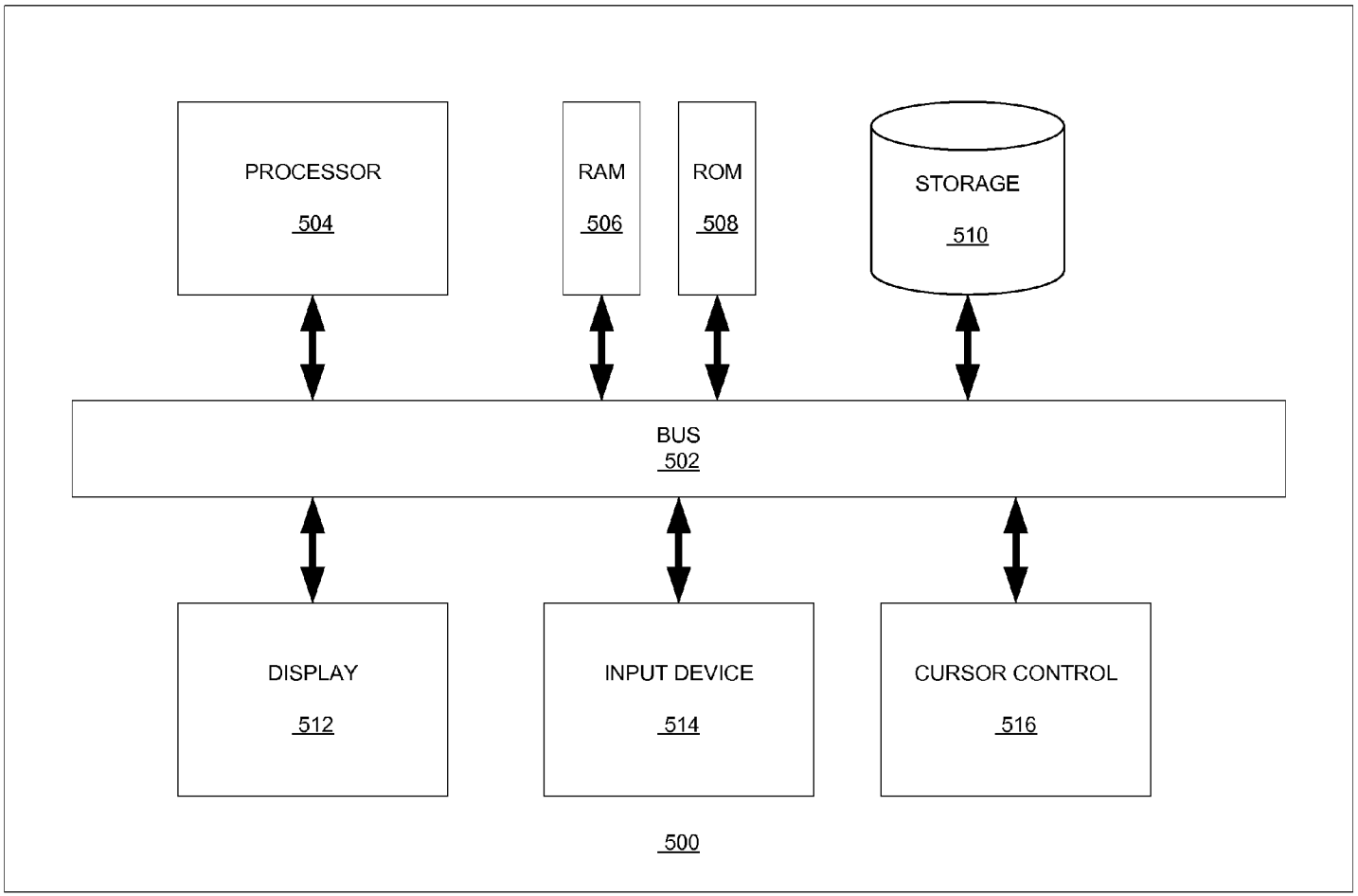
FIG. 5 is a block diagram illustrating an exemplary computer system.

FIG. 5 is a block diagram that illustrates a computer system 500, upon which embodiments of the present teachings may be implemented as which may incorporate or communicate with a system controller, for example controller 108 shown in FIG. 1, such that the operation of components of the associated mass spectrometer may be adjusted in accordance with calculations or determinations made by computer system 500. In various embodiments, computer system 500 can include a bus 502 or other communication mechanism for communicating information, and a processor 504 coupled with bus 502 for processing information. In various embodiments, computer system 500 can also include a memory 506, which can be a random access memory (RAM) or other dynamic storage device, coupled to bus 502, and instructions to be executed by processor 504. Memory 506 also can be used for storing temporary variables or other intermediate information during execution of instructions to be executed by processor 504. In various embodiments, computer system 500 can further include a read only memory (ROM) 508 or other static storage device coupled to bus 502 for storing static information and instructions for processor 504. A storage device 510, such as a magnetic disk or optical disk, can be provided and coupled to bus 502 for storing information and instructions.

In various embodiments, processor 504 can include a plurality of logic gates. The logic gates can include AND gates, OR gates, NOT gates, NAND gates, NOR gates, EXOR gates, EXNOR gates, or any combination thereof. An AND gate can produce a high output only if all the inputs are high. An OR gate can produce a high output if one or more of the inputs are high. A NOT gate can produce an inverted version of the input as an output, such as outputting a high value when the input is low. A NAND (NOT-AND) gate can produce an inverted AND output, such that the output will be high if any of the inputs are low. A NOR (NOT-OR) gate can produce an inverted OR output, such that the NOR gate output is low if any of the inputs are high. An EXOR (Exclusive-OR) gate can produce a high output if either, but not both, inputs are high. An EXNOR (Exclusive-NOR) gate can produce an inverted EXOR output, such that the output is low if either, but not both, inputs are high.

TABLE 1

Logic Gates Truth Table

| INPUTS | | OUTPUTS | | | | | | |
|---|---|---|---|---|---|---|---|---|
| A | B | NOT A | AND | NAND | OR | NOR | EXOR | EXNOR |
| 0 | 0 | 1 | 0 | 1 | 0 | 1 | 0 | 1 |
| 0 | 1 | 1 | 0 | 1 | 1 | 0 | 1 | 0 |
| 1 | 0 | 0 | 0 | 1 | 1 | 0 | 1 | 0 |
| 1 | 1 | 0 | 1 | 0 | 1 | 0 | 0 | 1 |

One of skill in the art would appreciate that the logic gates can be used in various combinations to perform comparisons, arithmetic operations, and the like. Further, one of skill in the art would appreciate how to sequence the use of various combinations of logic gates to perform complex processes, such as the processes described herein.

In an example, a 1-bit binary comparison can be performed using a XNOR gate since the result is high only when the two inputs are the same. A comparison of two multi-bit values can be performed by using multiple XNOR gates to compare each pair of bits, and the combining the output of the XNOR gates using and AND gates, such that the result can be true only when each pair of bits have the same value. If any pair of bits does not have the same value, the result of the corresponding XNOR gate can be low, and the output of the AND gate receiving the low input can be low.

In another example, a 1-bit adder can be implemented using a combination of AND gates and XOR gates. Specifically, the 1-bit adder can receive three inputs, the two bits to be added (A and B) and a carry bit (Cin), and two outputs, the sum (S) and a carry out bit (Cout). The Cin bit can be set to 0 for addition of two one bit values, or can be used to couple multiple 1-bit adders together to add two multi-bit values by receiving the Cout from a lower order adder. In an exemplary embodiment, S can be implemented by applying the A and B inputs to a XOR gate, and then applying the result and Cin to another XOR gate. Cout can be implemented by applying the A and B inputs to an AND gate, the result of the A-B XOR from the SUM and the Cin to another AND, and applying the input of the AND gates to a XOR gate.

TABLE 2

1-bit Adder Truth Table

| INPUTS | | | OUTPUTS | |
|---|---|---|---|---|
| A | B | Cin | S | Cout |
| 0 | 0 | 0 | 0 | 0 |
| 1 | 0 | 0 | 0 | 1 |

TABLE 2-continued 1-bit Adder Truth Table

| INPUTS | | | OUTPUTS | |
|---|---|---|---|---|
| A | B | Cin | S | Cout |
| 0 | 1 | 0 | 0 | 1 |
| 1 | 1 | 0 | 1 | 0 |
| 0 | 0 | 1 | 0 | 1 |
| 1 | 0 | 1 | 1 | 0 |
| 0 | 1 | 1 | 1 | 0 |
| 1 | 1 | 1 | 1 | 1 |

In various embodiments, computer system 500 can be coupled via bus 502 to a display 512, such as a cathode ray tube (CRT) or liquid crystal display (LCD), for displaying information to a computer user. An input device 514, including alphanumeric and other keys, can be coupled to bus 502 for communicating information and command selections to processor 504. Another type of user input device is a cursor control 516, such as a mouse, a trackball or cursor direction keys for communicating direction information and command selections to processor 504 and for controlling cursor movement on display 512. This input device typically has two degrees of freedom in two axes, a first axis (i.e., x) and a second axis (i.e., y), that allows the device to specify positions in a plane.

A computer system 500 can perform the present teachings. Consistent with certain implementations of the present teachings, results can be provided by computer system 500 in response to processor 504 executing one or more sequences of one or more instructions contained in memory 506. Such instructions can be read into memory 506 from another computer-readable medium, such as storage device 510. Execution of the sequences of instructions contained in memory 506 can cause processor 504 to perform the processes described herein. In various embodiments, instructions in the memory can sequence the use of various combinations of logic gates available within the processor to perform the processes describe herein. Alternatively hard-wired circuitry can be used in place of or in combination with software instructions to implement the present teachings. In various embodiments, the hard-wired circuitry can include the necessary logic gates, operated in the necessary sequence to perform the processes described herein. Thus implementations of the present teachings are not limited to any specific combination of hardware circuitry and software.

The term "computer-readable medium" as used herein refers to any media that participates in providing instructions to processor 504 for execution. Such a medium can take many forms, including but not limited to, non-volatile media, volatile media, and transmission media. Examples of non-volatile media can include, but are not limited to, optical or magnetic disks, such as storage device 510. Examples of volatile media can include, but are not limited to, dynamic memory, such as memory 506. Examples of transmission media can include, but are not limited to, coaxial cables, copper wire, and fiber optics, including the wires that comprise bus 502.

Common forms of non-transitory computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, PROM, and EPROM, a FLASH-EPROM, any other memory chip or cartridge, or any other tangible medium from which a computer can read.

In accordance with various embodiments, instructions configured to be executed by a processor to perform a method are stored on a computer-readable medium. The computer-readable medium can be a device that stores digital information. For example, a computer-readable medium includes a compact disc read-only memory (CD-ROM) as is known in the art for storing software. The computer-readable medium is accessed by a processor suitable for executing instructions configured to be executed.

In various embodiments, the methods of the present teachings may be implemented in a software program and applications written in conventional programming languages such as C, C++, etc.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

The embodiments described herein, can be practiced with other computer system configurations including hand-held devices, microprocessor systems, microprocessor-based or programmable consumer electronics, minicomputers, mainframe computers and the like. The embodiments can also be practiced in distributing computing environments where tasks are performed by remote processing devices that are linked through a network.

It should also be understood that the embodiments described herein can employ various computer-implemented operations involving data stored in computer systems. These operations are those requiring physical manipulation of physical quantities. Usually, though not necessarily, these quantities take the form of electrical or magnetic signals capable of being stored, transferred, combined, compared, and otherwise manipulated. Further, the manipulations performed are often referred to in terms, such as producing, identifying, determining, or comparing.

Any of the operations that form part of the embodiments described herein are useful machine operations. The embodiments, described herein, also relate to a device or an apparatus for performing these operations. The systems and methods described herein can be specially constructed for the required purposes or it may be a general purpose computer selectively activated or configured by a computer program stored in the computer. In particular, various general purpose machines may be used with computer programs written in accordance with the teachings herein, or it may be more convenient to construct a more specialized apparatus to perform the required operations.

Certain embodiments can also be embodied as computer readable code on a computer readable medium. The computer readable medium is any data storage device that can store data, which can thereafter be read by a computer system. Examples of the computer readable medium include hard drives, network attached storage (NAS), read-only memory, random-access memory, CD-ROMs, CD-Rs, CD-RWs, magnetic tapes, and other optical and non-optical data storage devices. The computer readable medium can also be distributed over a network coupled computer systems so that the computer readable code is stored and executed in a distributed fashion.

Results

The effectiveness of isolating a precursor can be characterized by applying a suitable isolation waveform, and taking spectra that monitor the abundance of a certain m/z species for a series of trapping RF values that cause the precursor to be stepped through frequencies above, at, and below that of the isolation notch. The resulting data produces a visualization of the isolation notch in what are sometimes termed "isolatograms". FIGS. 6A, 6B, 6C, and 6D compare the isolation performance for several isolation schemes, including those of the prior art and those for the current embodiment for a nominally 4 Da isolation width, The isolatogram can be viewed as the impulse response of the isolation process; the response of the system to a single m/z species. Ideally, it is desirable that the response be rectangular, that is, that it have the form $$rect\left(\frac{x}{2W}\right) = \begin{cases} |x| < W \rightarrow 1 \\ \text{else} \rightarrow 0 \end{cases},$$

where x is the m/z axis, and W is the desired width of the isolation. In this ideal case, all ions having frequencies where there is zero waveform energy will stay in the trap and all ions having frequencies where there is non-zero waveform energy will be ejected from the trap. Realistically, this is difficult to achieve, and, in fact, becomes more challenging at higher ion densities where space charge effects are greater. Each of the different traces of FIGS. 6A, 6B, 6C, and 6D shows the effectiveness of a particular isolation waveform strategy when different target numbers of precursor ions, from 1e4 to 9.8e4 are present. Note that the isolations of the precursor ion at m/z 524.3 are performed in the presence of from 5e5 to 5e6 total number of ions so that the precursor species of interest at m/z 524.3 only makes up about 2% of the total ion population. The y axis is an arbitrarily scaled measure of the number of ions. The x axis is the difference between the oscillation frequency of the m/z of the ion being isolated (524.3) and the center of the isolation notch (expressed in m/z), as the trapping voltage is iterated from high to low value. Therefore the negative x axis values correspond to the precursor having a lower frequency than the waveform notch, and the positive x axis values correspond to the precursor having a higher frequency than the waveform notch. The discrete data points are experimental data, while the solid lines are idealizations of the waveform impulse response for comparative purposes, using the equation $f(x)=ae^{-b^6(x-c)^6}$.

Figure 6A:
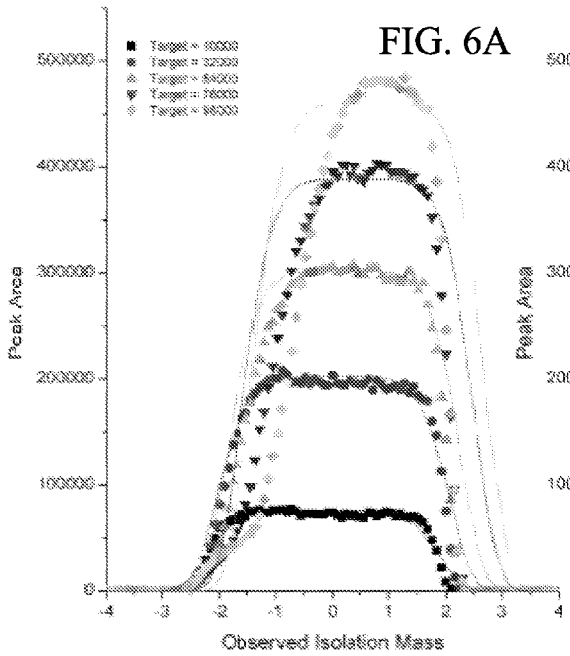
FIGS. 6A-6D show an exemplary comparison between methods of isolating ions, in accordance with various embodiments.

When isolation is performed with a single isolation waveform applied after injection of ions into the ion trap, the isolation performance shown in FIG. 6A is close to ideal for low ion population numbers. However, at larger ion populations the response deviates from the ideal shape, especially on the low frequency (negative isolation mass) side. This phenomenon leads to dramatic decreases in sensitivity, especially for complicated mixtures and narrow isolation widths. These deviations can be caused by the space charge potential of the ions in the trap, and also by the increased radius of the ion cloud which experiences an increased effect of the nonlinear fields. Both effects can induce a shift in ion oscillation frequency.

Figure 6B:
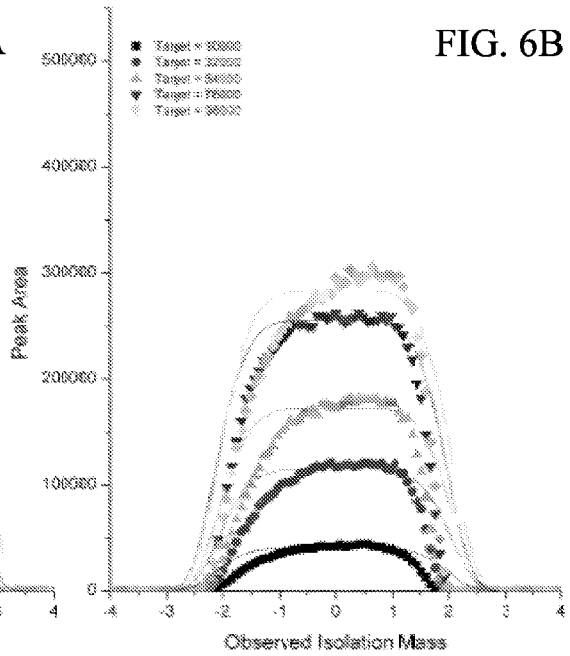
Figure 6C:
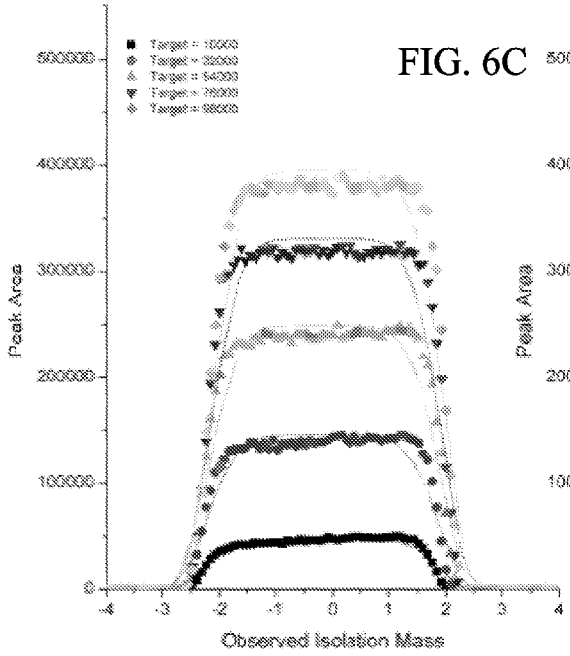
Figure 6D:
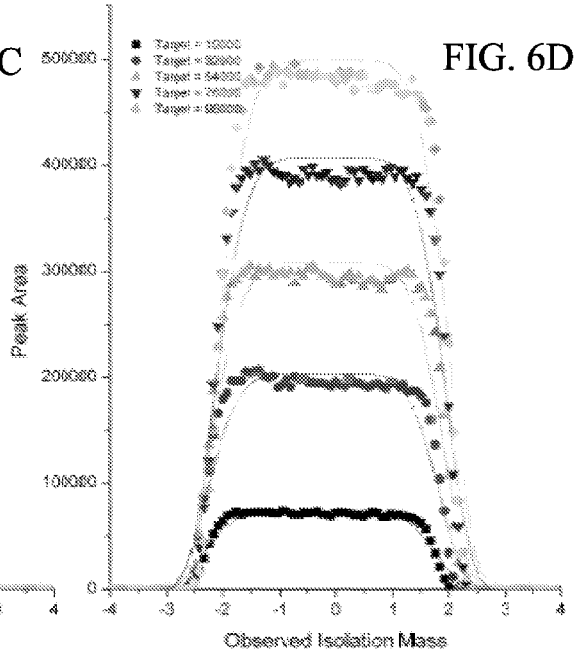

When isolation waveforms are applied during the injection process, as in FIG. 6B, the dependence of the isolation impulse response shape on the ion population is decreased. However sensitivity is somewhat reduced, and additionally the isolation response function is no longer rectangular. The influence of the nonlinear portion of the trapping field can play a larger role during injection when ions have relatively larger radii, and the non-ideal response is observed even at low ion targets. When a waveform having 10 Da isolation notch width is applied during injection, and subsequently a waveform with 4 Da isolation notch width is applied after injection, as shown in FIG. 6C, the result is an improvement in both sensitivity and isolation impulse response shape. When no waveform is applied during injection, but two waveforms are applied sequentially after injection, with 14 Da width and 4 Da width respectively, as shown in FIG. 6D, the impulse response of the isolation is likewise nearly ideal, and sensitivity is improved once again.

What is claimed is:

1. A mass spectrometer comprising:
a radio frequency ion trap; and
a controller configured to:
cause an ion population to be injected into the radio frequency ion trap;
supply a first isolation waveform to the radio frequency ion trap for a first duration, the first isolation waveform having at least a first wide notch at a first mass-to-charge ratio; and
supply a second isolation waveform to the radio frequency ion trap for a second duration, the second isolation waveform having at least a first narrow notch at the first mass-to-charge ratio;
the first wide notch and the first narrow notch have q values at a target mass-to-charge ratio that differ by not greater than a factor of about 2;
the first isolation waveform and the second isolation waveform being substantially similar in amplitude; and
the first and second isolation waveforms being effective to isolate one or more precursor ions from the ion population.

2. The mass spectrometer of claim 1, wherein the first wide notch encompasses the first narrow notch.

3. The mass spectrometer of claim 1, wherein the controller is configured to supply the first isolation waveform concurrent with the injection of the ion population and supply the second isolation waveform subsequent to the injection of the ion population.

4. The mass spectrometer of claim 1, wherein the controller is configured to supply the first isolation waveform subsequent to the injection of the ion population and supply the second isolation waveform subsequent to the first isolation waveform.

5. The mass spectrometer of claim 1, wherein the first wide notch and the first narrow notch have q values that differ by not greater than a factor of about 1.5.

6. The mass spectrometer of claim 5, wherein the q values of the first wide notch and the first narrow notch differ by not greater than a factor of about 1.25.

7. The mass spectrometer of claim 1, wherein a width of the first wide notch is not less than about 8 Da.

8. The mass spectrometer of claim 1, wherein a width of the first narrow notch is not greater than about 5 Da.

9. The mass spectrometer of claim 1, wherein a width of the first wide notch is not less than about 2 times a width of the first narrow notch.

10. The mass spectrometer of claim 9, wherein the width of the first wide notch is not less than about 2.5 times the width of the first narrow notch.

11. The mass spectrometer of claim 1, wherein the first waveform includes a second wide notch at a second mass-to-charge ratio and the second waveform includes a second narrow notch at the second mass-to-charge ratio.

12. The mass spectrometer of claim 11, wherein a q value of the second wide notch and a q value of the second narrow notch differ by not greater than a factor of about 2.

13. The mass spectrometer of claim 1, wherein the controller is further configured to supply additional isolation waveforms having successively narrower notches at the first mass-to-charge ratio.

14. A mass spectrometer comprising:
a radio frequency ion trap; and
a controller configured to:
cause an ion population to be injected into the radio frequency ion trap;
supply a first isolation waveform to the radio frequency ion trap for a first duration, the first isolation waveform having at least a first wide notch encompassing a first mass-to-charge ratio; and
supply a second isolation waveform to the radio frequency ion trap for a second duration, the second isolation waveform having at least a first narrow notch encompassing the first mass-to-charge ratio;
the first wide notch and the first narrow notch have q values at the first mass-to-charge ratio greater than about 0.45;
the first isolation waveform and the second isolation waveform being substantially similar in amplitude; and
the first and second isolation waveforms being effective to isolate one or more precursor ions from the ion population.

15. The mass spectrometer of claim 14, wherein the first wide notch encompasses the first narrow notch.

16. The mass spectrometer of claim 14, wherein the controller is configured to supply the first isolation waveform concurrent with the injection of the ion population and supply the second isolation waveform subsequent to the injection of the ion population.

17. The mass spectrometer of claim 14, wherein the first wide notch and the first narrow notch have q values that differ by not greater than a factor of about 2.0.

18. The mass spectrometer of claim 14, wherein a width of the first wide notch is not less than about 8 Da.

19. The mass spectrometer of claim 14, wherein a width of the first wide notch is not less than about 2 times a width of the first narrow notch.

20. The mass spectrometer of claim 14, wherein the first waveform includes a second wide notch at a second mass-to-charge ratio and the second waveform includes a second narrow notch at the second mass-to-charge ratio.

21. The mass spectrometer of claim 14, wherein the controller is further configured to supply additional isolation waveforms having successively narrower notches at the first mass-to-charge ratio.

22. A mass spectrometer comprising:
a radio frequency ion trap; and
a controller configured to:
cause an ion population to be injected into the radio frequency ion trap;

supply a first isolation waveform to the radio frequency ion trap for a first duration, the first isolation waveform having a plurality of wide notches centered at a plurality of target mass-to-charge ratios; and supply a second isolation waveform to the radio frequency ion trap for a second duration, the second isolation waveform having a plurality of narrow notches centered at the plurality of target mass-to-charge ratios;

at a given target mass-to-charge ratio, the corresponding wide and narrow notches have q values that differ by not greater than a factor of about 2;

the first isolation waveform and the second isolation waveform being substantially similar in amplitude; and the first and second isolation waveforms being effective to isolate a plurality of precursor ions from the ion population.

23. The mass spectrometer of claim 22, wherein the controller is configured to supply the first isolation waveform subsequent to the injection of the ion population and supply the second isolation waveform subsequent to the first isolation waveform.

24. The mass spectrometer of claim 22, wherein the wide notches have a width of not less than about 8 Da.

25. The mass spectrometer of claim 22, wherein, at a given target mass-to-charge ratio, the corresponding wide notch has a width of not less than about 2 times a width of the corresponding narrow notch.

26. The mass spectrometer of claim 22, wherein the controller is further configured to supply additional isolation waveforms having successively narrower notches centered at the plurality of target mass-to-charge ratios.

27. A mass spectrometer comprising:

a radio frequency ion trap; and a controller configured to:

cause an ion population to be injected into the radio frequency ion trap;

supply a first isolation waveform to the radio frequency ion trap for a first duration, the first isolation waveform having a plurality of wide notches centered at a plurality of target mass-to-charge ratios; and supply a second isolation waveform to the radio frequency ion trap for a second duration, the second isolation waveform having a plurality of narrow notches centered at the plurality of target mass-to-charge ratios;

at a highest target mass-to-charge ratio, the corresponding wide and narrow notches have q values greater than about 0.45;

the first isolation waveform and the second isolation waveform being substantially similar in amplitude; and the first and second isolation waveforms being effective to isolate a plurality of precursor ions from the ion population.

* * * * *